United States Patent [19]

Biotteau

[11] 4,135,460

[45] Jan. 23, 1979

[54] AUTOMATIC GUIDING DEVICE FOR THE WORKPIECE ON A SEWING MACHINE

[75] Inventor: Gérard Biotteau, Saint-Pierre-Montlimart (Maine et Loire), France

[73] Assignee: Societe Anonyme Manufacture Francaise des Chaussures Eram, France

[21] Appl. No.: 787,923

[22] Filed: Apr. 15, 1977

[30] Foreign Application Priority Data

Apr. 21, 1976 [FR] France ..... 76 11707

[51] Int. Cl.[2] ..... D05B 35/10

[52] U.S. Cl. ..... 112/153; 112/205

[58] Field of Search ..... 112/205, 204, 153, 150, 112/136, 121.11, 121.12

[56] References Cited

U.S. PATENT DOCUMENTS

| | | | |
|---|---|---|---|
| 2,971,483 | 2/1961 | Cordier | 112/205 |
| 3,598,070 | 8/1971 | Rosenberg | 112/205 |
| 3,609,373 | 9/1971 | Desai et al. | 112/205 X |
| 3,752,097 | 7/1973 | Fuller, Jr. et al. | 112/153 X |
| 3,970,017 | 7/1976 | Babson et al. | 112/205 |
| 4,013,026 | 3/1977 | Hall | 112/205 X |

FOREIGN PATENT DOCUMENTS

| | | | |
|---|---|---|---|
| 2278819 | 3/1976 | France | 112/205 |

*Primary Examiner*—H. Hampton Hunter
*Attorney, Agent, or Firm*—Young & Thompson

[57] ABSTRACT

The present invention relates to an automatic guiding device for the workpiece on a sewing machine of the type imposing a drag on the workpiece via a presser foot and claws with a pressure inducing foot, comprises, in or near the edge of the pressure inducing foot which is in the vicinity of the presser foot, a cut-out or window through which passes the stem of the guiding pressure inducing member, said stem having its extremity dome shaped and pressing directly the workpiece onto the plane surface of the work table.

This device allows stitching at a distance of 5 millimeters from the workpiece edge.

5 Claims, 8 Drawing Figures

AUTOMATIC GUIDING DEVICE FOR THE WORKPIECE ON A SEWING MACHINE

French patent No. 74,16917 registered in the name of the Applicant of the May 15, 1974 for an "automatic guiding device for the workpiece on a sewing machine" relates to a guiding device for the workpiece on a sewing machine comprising substantially a pressure inducing member susceptible of coming to bear upon the workpiece as it is being worked, laterally and towards the outside in relation to the stitching needle, in order to form a fixed point. The workpiece being, while it is being stitched, periodically driven along the so-called advance direction of the stitching by the presser foot and the stitching needle, according to steps equal to the stitch length, when the pressure inducing member is bearing upon the workpiece, said workpiece rotates about the centre formed by said pressure inducing member and the stitch is made along a regular polygonal path assimilable to a circle having the pressure inducing member for centre and the distance of the pressure inducing member to the stitching needle for radius. If the pressure inducing member is caused to bear on the workpiece only while one out of n stitching points is made, a polygonal path is made assimilable to a circle having a radius about n times larger. However, such a guiding device does only allow to work along convex curvatures, i.e. curvatures having their centre on the same side as the pressure inducing member in relation to the stitching needle. This guiding device being provided for machines which are called "hemming" and "binding" sewing machines, i.e. machines for stitching along the edge of a workpiece, either to fix a braid onto said edge or to attach integrally to each other along their common edge two superimposed workpieces, the edge of said workpiece is used for guidance control, the stitching being effected at a constant distance from said edge. According to the aforesaid patent, and in order to work along paths with a concave curvature, there is therefore provided an abutment member mounted laterally towards the inside and slightly in advance of the stitching needle so that at the beginning of a path with concave curvature which corresponds to the approach towards the inside of the workpiece edge which is then more remote from the needle than the abutment member, the bearing point of the workpiece edge which comes in abutment against said abutment member forms a pivoting centre for the workpiece which is dragged by the stitching needle and the presser foot. In a hemming sewing machine, said abutment member is formed by the mechanical part applying the braid onto the workpiece edge. Further, when a path with convex curvature is beginning, the workpiece edge which comes near the stitching needle has a tendency to pass from the inside towards the outside in relation to the advance path of the stitch, i.e. in relation to the work path of the stitching needle, and according to said prior french patent, this deviation of the edge is detected for controlling the pressure inducing member.

A similar guiding device had already been disclosed by Cordier, in particular in U.S. Pat. No. 2,971,483, but this patent comprising two pressure inducing points placed laterally on either side of the presser foot and brought to bear alternately on the workpiece, was not applicable to hemming sewing machines. Moreover, in Cordier's device, one of the points is always bearing on the workpiece while normally the work comprises several rectilineal paths. As a result, Cordier's device causes normally the continuous alternate actions of two pressure inducing members forming an undulated seam. In order to ensure correct operation, it is indispensable that the guiding device acts only as corrector when the sewing machine comprising the braiding device or a fixed abutment member does not automatically follow the workpiece edge.

U.S. Pat. No. 3,598,070 discloses also a device of the same type. In order to attempt to palliate the disadvantages of Cordier's patent, this patent describes a pressure inducing member which reciprocates vertically in synchronism with the reciprocating movement of the stitching needle so that the pressure inducing member is brought to bear loosely on the workpiece during the displacement step of the needle so that the workpiece may slide under it, it being possible that this loose contact is made tighter when the sensing means detects a convex curvature. According to the patent text, such a device may be used only on one type of sewing machine called "walking needle" sewing machine, while Cordier's patent relates to a sewing machine of the presser foot and claws type. Due to the complexity of the pressure inducing device, the device of U.S. Pat. No. 3,598,070 is only able to act at an important distance from the stitching needle and, because of its make-up and the way it operates through a more or less powerful squeezing action, it is extremely sensitive to any thickness variation of the material. Finally, the pressure inducing member acting via a pressing surface, the workpiece is prevented from rotating when it follows the movement of the stitching needle as long as the pressure inducing member is applying a tight pressure and, accordingly, the work point of the pressure inducing member cannot be in the vicinity of the stitching needle work path due to the stresses which would be applied on the needle and the material.

Generally, none of the previously described devices allows to stitch at less than 5 millimeters from the workpiece edge and for instance at 3 millimeters from the edge of said workpiece, the work path presenting convex curvatures having a radius inferior to about twenty millimeters.

The device disclosed in French patent No. 74,16917 allows such realizations with a sewing machine of known type comprising a driving means for the workpiece via a presser foot and claws with a pressure inducing foot placed laterally in relation to the presser foot and causing the workpiece to be stationary during the rearward movement of the stitching needle, the presser foot and the claws. In such a device, the pressure inducing member is, characteristically, brought in contact with the workpiece only for correcting an accidental concave deviation of the stitch or for stitching along a convex portion of the work path.

However, it displays some minor faults resulting: from the fact that the pressure inducing member and its cooperating portion, pivot-bearing or point, being placed outside the pressure inducing foot, the radius of curvature of the portions remains relatively large; from the fact that the workpiece has a tendency, under the effect of the stitch, to assume a longitudinal curvature which lifts the upstream part of the workpiece above the work-table and destroys the control accuracy by the sensing member; from the fact that the position of the sensing point of edge deviation which controls the operation of the pressure inducing member must be modified in relation with the radius of curvature of the profile convex curvatures, failing which the point where the curvature begins and also the point where the curved stitch ends do not correspond to the transition point of the convex curvature with the rectilineal edges; and finally and above all from the fact that the machine having a tendency to pivot the workpiece in clockwise direction, the pressure inducing member has to be operated episodically for compensating such a tendency, with the result that the stitched workpiece presents a faulty appearance with a tendency for undulations perpendicular to its plane with further the difficulty that for ensuring said correction, the sensing point controlling the pressure inducing member has to be very close to the edge theoretical position, which does not correspond to the position of the sensing point at the beginning of a convex curvature of small radius.

On the other hand, according to theoretical geometry, it is impossible to control with a single pinpoint sensor the position of the workpiece edge on a path which is perpendicular to the travel direction of the workpiece, a pressure inducing member for making convex curvature having a small radius of curvature with different radii of curvature, the guiding principle disclosed in U.S. Pat. Nos. 2,971,483 and 3,598,070 being only applicable to convex curvatures having a large radius of curvature.

The present invention palliates such disadvantages in a sewing machine of the type comprising the feeding of the workpiece by a presser foot and claws with a pressure inducing foot bearing upon the workpiece in order to apply said workpiece on the work-table and to maintien it during the rearward travel of the stitching needle, the presser foot and the claws, said pressure inducing foot being on the other hand lifted during the forward movement of the stitching needle, an automatic guiding device for the workpiece causing a point of the workpiece to remain stationary under the control of a sensing device for the position of the workpiece edge, said guiding device comprising, in or near the edge of the pressure inducing foot which is in the vicinity of the presser foot, a cut-out or window through which passes the stem of a guiding pressure inducing member, said stem having a dome-shaped extremity which presses directly the workpiece onto the plane surface of the work-plate.

With such a construction, the acting point of the pressure inducing member may be brought nearer to the stitching needle up to about 5 millimeters from the stitching needle work path, with the result that stitches may be made along convex curvature paths having radii of the same order. Due to the dome-shaped extremity of the pressure inducing member, the workpiece is allowed to rotate while being applied onto the smooth working surface of the work-plate. Owing to this, the guiding pressure inducing member has not to be lifted during the rearward movement of the stitching needle corresponding to the making of a stitch, thus ensuring a radius of curvature which is constant with a slight narrowing of the stitch which is slightly shorter in the curved area, the stress imposed on the material being relaxed during the disengagement period of the stitching needle and the driving device. Said narrowing of the stitch in the convex curvatures represents an advantage since the braid is better applied in an area where it would have a tendency to pucker, and the final appearance of the workpiece is greatly improved.

According to another to feature of this invention, a resilient applicator formed by a simple wire spring is placed transversely above the workpiece, upstream of the edge position sensor.

Said second feature avoids operating faults resulting from the tendency of the workpiece to assume a longitudinal curvature which lifts it from the work-plate.

According to a further feature of the invention, the sensing device for the workpiece edge is made of a plurality of photoelectric cells staggered along a line which is substantially perpendicular to the advance direction of the work, said cells being switchable by a selector in the driving circuit for the guiding pressure inducing member.

According to a further feature, the pressure applied by the guiding pressure inducing member upon the workpiece is adjustable in relation to the radius of curvature of the workpiece convex part in such manner as to be stronger when the radius of curvature is smaller. According to a preferential embodiment, a control of the applied pressure is made by the cell selection selector.

According to a further feature, a delay is introduced in the guiding pressure inducing member control by the sensor at least for the part of the control which causes the guiding pressure inducing member to come to bear on the workpiece. Said delay may result from the constitution of the driving device itself and for instance from its inertia.

The three above feature cooperate for correctly guiding the workpiece in the case of convex curvatures having different radii of curvature. In the case of a convex curvature having a small radius of curvature, the workpiece free edge comes back in fact much more quickly towards the stitching needle work path than in the case of a curve having a large radius of curvature, but such a movement is only perceptible in the very near vicinity of the beginning of the curvature; it is therefore necessary that the sensor should be near the guiding pressure inducing member whereas on the contrary, in this position, it would act too slowly in the case of a large radius of curvature. In the case of a small radius of curvature of the stitch equal to the distance between the guiding pressure inducing member and the stitching needle, the workpiece has to turn about the pressure point of the guiding pressure inducing member, whereas with a larger radius of curvature, it is preferable that the workpiece may slide under the guiding pressure inducing member for each stitch rather than operate according to a hit-or-miss pattern. This result is reached with the characteristic adjusting the bearing pressure in relation to the radius of curvature. Finally, in order to obtain a theoretically perfect guidance, the workpiece edge sensing point should be at the extremity of the radius passing the pressure inducing foot and the stitching needle. But such a solution is not applicable in practice due on the one hand to the inertia of the driving means which is relatively high because of the speed of such sewing machines, which, with 3000 stitches per minute, reach a stitching linear speed of 6 meters/minute, i.e. 1 millimeter per 1/100 of second and on the other hand to the fact of the presence of the braiding attachment or of the guiding abutment member, said reasons not allowing to use a sensor even in the form of a photo-electric cell. One is therefore compelled to position the cell upstream of said theoretical sensing point and towards the outside, i.e. towards the stitching needle and the guiding pressure inducing member, in relation to said sensing point.

Finally, according to a further feature, the machine comprises a resilient pressure inducing means maintained in constant pressure upon the workpiece and operating at a point situated opposite the fixed abutment member or the braiding attachment in relation to the stitching needle. As previously discussed, when the workpiece is moved forward under the action of the presser foot, the claw and the stitching needle, the workpiece is subjected to a certain braking force coming from the braiding attachment or the abutment member provided for ensuring the concave curvatures. The result of this braking force is an internal stress in the part of the workpiece which is between the stitching needle and the edge, said stress being transmitted, at the moment the presser foot is lifted, to the part reaching the pressure inducing foot, then when said pressure inducing foot is lifted, to the whole workpiece which therefore has a tendency to travel in advance in relation to the drag applied by the presser foot and therefore to rotate in clockwise direction. The object of the resilient pressure inducing member is to create all the time a braking force which counterbalances the braking force which is exerted on the other side of the stitching needle. Said resilient pressure inducing member is different from the guiding pressure inducing member according to U.S. Pat. No. 3,598,070 in as much as it is constantly resiliently applied onto the workpiece during the movement forward as well as during the movement backward of the stitching needle. On the other hand, the pressure inducing member of the U.S. patent is lifted during this return movement, thereby allowing the resilient stress created during the forward movement of the needle to spread in the whole workpiece.

It is necessary that the resilient pressure inducing member should exert an adjustable pressure and remain applied to the workpiece even in the convex curvatures. For so doing, the resilient pressure inducing member is mounted on the pressure inducing foot, preferably in the vicinity of the pressure inducing foot edge which is opposite the presser foot, and it is biased by an adjustable spring. However, if the resilient pressure inducing member is to remain applied on the workpiece while the pressure inducing foot is being lifted, it should be lifted when the presser foot and the pressure inducing foot are lifted for engaging the workpiece. Consequently, an abutment attachment is provided for limiting the movement downwards of the resilient pressure inducing member in relation to the presser foot substantially down to the lifting height of the pressure inducing foot during the stitching needle forward movement.

These and other features of the present invention will become more apparent from the following description of one embodiment of the automatic guiding device when taken in conjunction with the accompanying drawings, wherein.

Figure 1:
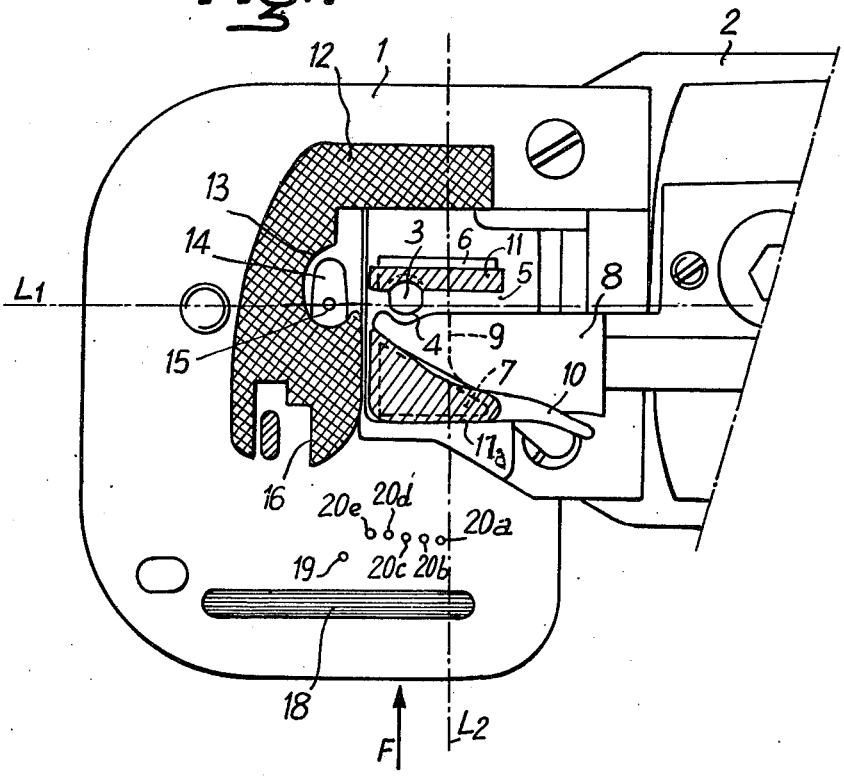
FIG. 1 is a plan view of the working table with the indication of the relative positions of the operating surfaces of the various elements.

In FIG. 1 is shown in detail the operating surfaces of the various elements which cooperate for ensuring the forward movement and guiding of the workpiece, those of said elements which are new being later described in more detail with reference to FIGS. 6 and 8 and their operation being discussed with reference to FIGS. 2 and 5.

The embodiment of FIG. 1 relates to an "automatic binding" sewing machine, i.e. a sewing machine which is automatically fixing a braid applied straddling on the edge of a pre-cut workpiece. However, the invention is also applicable to other sewing machines such as binding sewing machines, the essential difference lying in the fact that the "braiding attachment" which applies the braid onto the workpiece edge is replaced by a fixed abutment member or a roller.

The members previously known are the work-plate 1 supported by an arm 2, the needle which is represented only by its axis 3, said needle passing through a bore 4 formed in the claws support 5 which is reciprocating with an amplitude equal to the stich length according to the direction of arrow F, said claws support carrying two claws 6 and 7 which are under the workpiece. The nose 8 of the braiding attachment extends forward past bore 4 and the inner edge of its V-shaped channel corresponds substantially to the contour of the workpiece, and $L_2$ will be the reference given to the line parallel to F passing at the bottom of said channel. The presser foot 10 bears upon the workpiece via two surfaces 11 and **11*a* substantially in coincidence with claws 6 and 7, the surfaces 11 and 11*a* reciprocating in known manner along arrow F in synchronism with the claws when applied to the workpiece, the rearward movement being effected when the stitching needle is disengaged from the workpiece, the presser foot being simultaneously lifted. Finally, a pressure inducing foot 12 presses the workpiece onto the work-plate to keep it stationary while the presser foot is being lifted, the pressure inducing foot being also lifted during the forward movement of the presser foot 10** and the stitching needle.

According to the present invention, a cut-out 13 is provided on the edge of the pressure inducing foot 12 nearer to the presser foot. A plan wear-part 14 is provided in the working surface at right angles with said cut-out and the rounded point 15 of the guiding pressure inducing member comes to bear upon the workpiece at right angles with said workpiece. Another cut-out 16 is provided in the pressure inducing foot on the opposite side of line $L_2$ in relation to the operation line of the guiding pressure inducing member and in said cut-out passes a resilient pressure inducing member pressing the workpiece with a surface 17. Finally, a resilient applicator comes to bear on the workpiece in the upstream part of the working surface 1 along a linear surface 18 perpendicular to F so as to maintain the workpiece flat against the working surface.

Photoelectric cells 19 and 20*a* to 20*e* are mounted in the working-plate, cell 19 detecting the end of the workpiece and cells 20*a* to 20*e* being provided for sensing the deviation of the workpiece contour in relation to line $L_2$ for controlling the guiding pressure inducing member. Cells 20*a* to 20*e* may be switched selectively in the control circuit of the guiding pressure inducing member, an example of such a circuit having been described in detail in the abovementioned French patent No. 74,16917.

The stitching needle makes the stitches at about 3.5 mm from the coutour of the workpiece and the distance between the operation point of the guiding pressure inducing member and the needle is about 6.5 mm, this allowing to bind workpieces having convex radii of curvature of 10 mm.

Figure 2:
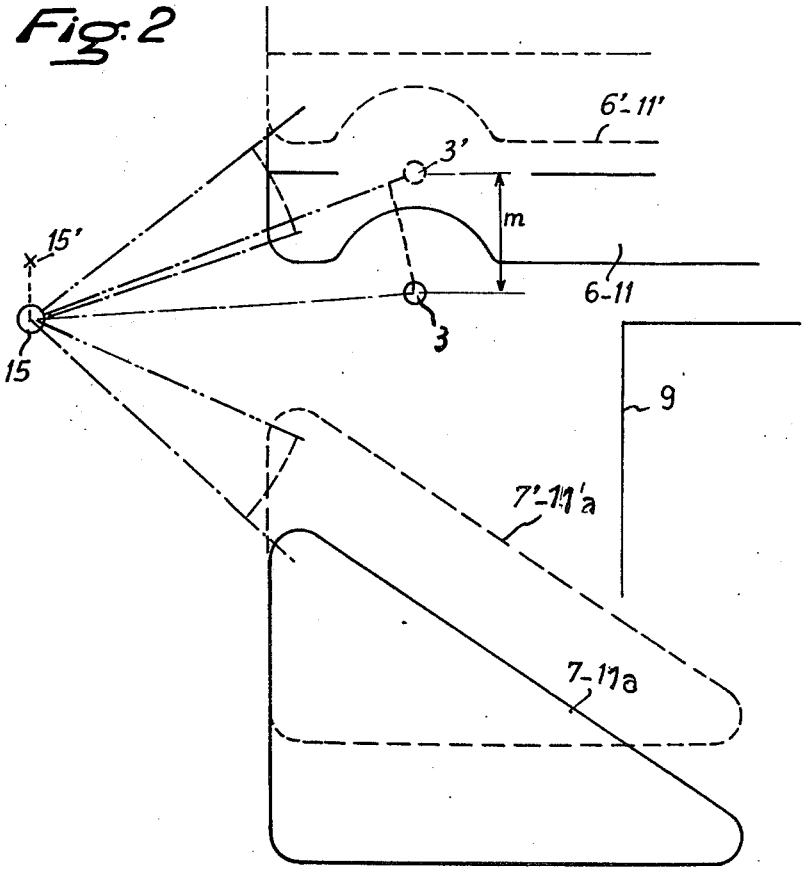
FIG. 2 is a view on a larger scale for explaining the stresses to which the workpiece is subjected when a convex stitch with minimum radius of curvature is made.

Reference being made to FIG. 2, the stresses which arise in the workpiece in the case of a sewing machine in which the guiding pressure inducing member 15 operates at a very small distance from the stitching needle 3 will first be examined. When a stitch is made, the needle penetrates the workpiece at point 3 and the claws and presser foot squeeze the workpiece between surfaces 6–11 and 7–11*a*. The needle in the workpiece comes then to 3' while the presser foot and the claws come to 6'–11' and 7'–11*a'*. If the guiding pressure inducing member 15 is very energetically applied onto the workpiece in order to form a fixed point, the stitching needle will then exert an elongating stress on the part stituated between itself and the guiding pressure inducing member 15. The game applies for the part between the guiding pressure inducing member and the claws 6–11. On the other hand, the part between the claws 7–11*a* and the guiding pressure inducing member 15 is going to be pressed. Simultaneously, the workpiece is subjected to a torque exerting also a stress. It will rotate by a certain angle but when it will be disengaged from the needle, the presser foot and the claws, the relaxation of the stresses will bring back the point 3' towards point 3, and this explains the narrowing of the stitches. If the material of the workpiece is relatively rigid or the pressure applied by the guiding pressure inducing member 15 insufficient in view of said rigidity, the workpiece will slide under the guiding pressure inducing member towards position 15' and this will enlarge the convex radius of curvature.

In order to make a convex stitch with a minimum radius, there should not be any displacement of point 15, and this necessitates a very strong pressure. Generally, the pressure should be such that, taking the rigidity of the workpiece material into account, the sliding movement will be limited to a distance 15–15' which is a function of the radius of curvature of the stitch. A priori, this adjustment appears to be extremely difficult to carry out, but in fact the pressure applied may vary within certain limits because if it is slightly too great in relation to the stresses exerted by the claws and needle, the rotation will be greater than that corresponding to the contour curvature and the stitch point, and the workpiece contour will come into abutment against the bottom 9 of the braiding attachment groove which, through a braking operation, will still shorten the stitch and give rise to a torque about the needle which will be added to the hereabove stresses and increase the sliding drag applied to the workpiece under the guiding pressure inducing member 15. The more rigid the material of the workpiece is, the wider are the limits within which the pressure is adjustable.

Figure 5:
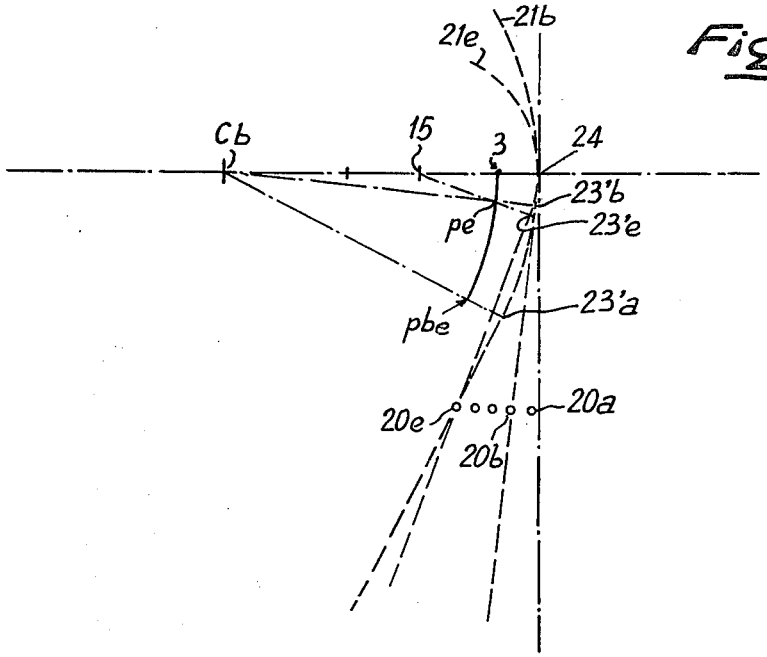
FIG. 5 is a view similar to FIG. 4 explaining the part played by the position of the sensing point on the transition between the end of the convex stitch with the straight path which follows.
Figure 3:
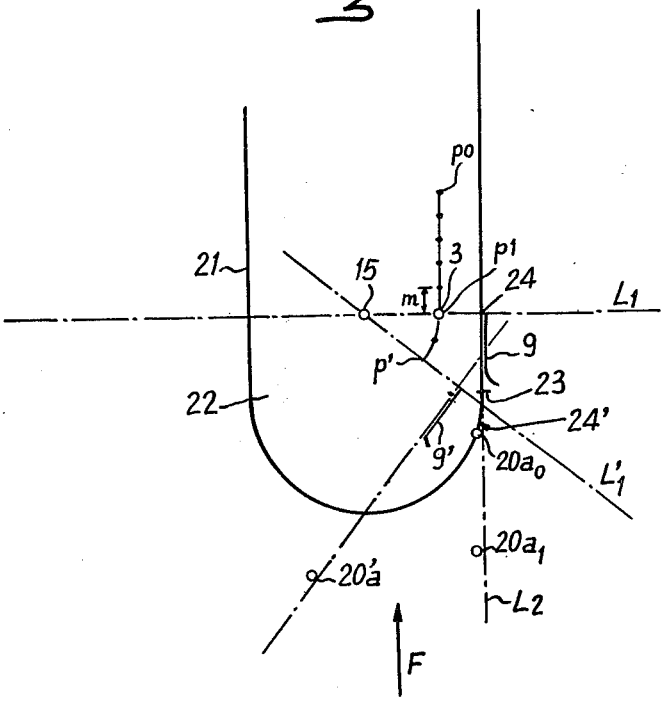
FIG. 3 is a schematic view explaining the necessity of adjusting the position of the edge sensing point in relation to the radius of curvature.
Figure 4:
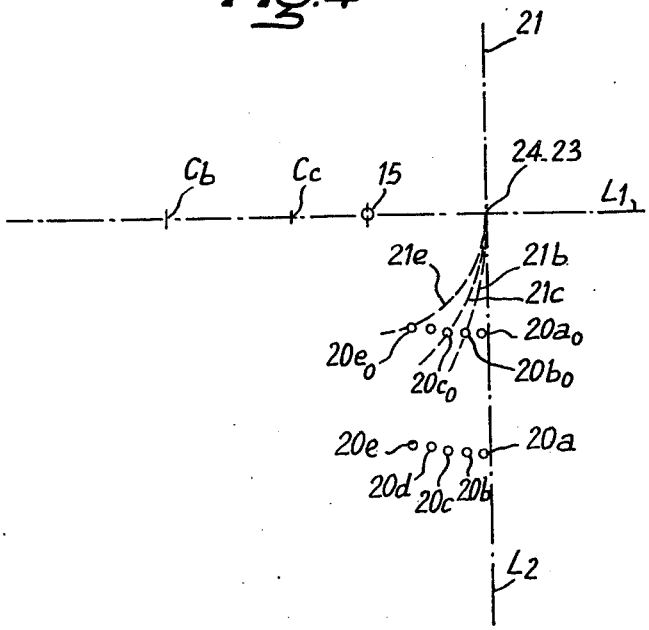
FIG. 4 is a view explaining the choice of the position of the sensing point in relation to the radius of curvature for obtaining a correct beginning of a convex stitch.

Reference being made to FIGS. 3 to 5, the importance of the position of the workpiece contour sensing point for controlling the guiding pressure inducing member 15 which has to be a function of the radius of curvature of the convex curvature to stitch, will now be examined.

In these Figures, there has been only represented the stitching needle 3 which is reciprocating (arrow m) with an amplitude equal to the stitch length, the pressure point 15 of the guiding pressure inducing member, the edge 21 of the workpiece 22 to be bound, the abutment member formed in this case by the bottom 9 of the braiding attachment 8 groove and the various possible positions 20*a* to 20*e* for the sensing point, i.e. for the selected photoelectric cell.

In theory, it is when point 23, which is the transition between the rectilineal edge of the workpiece and the convex part, reaches point 24 situated on the line $L_1$ perpendicular to edge $L_2$ passing by the pressure point 15 of the guiding pressure inducing member that the guiding pressure inducing member should operate to rotate the workpiece. But on the one hand, the guiding pressure inducing member does not operate instantaneously, and on the other hand, if a detection is to take place, the edge must be displaced in relation to the sensing point, which is not the case for point 24 since the edge should also pass exactly at this point and, finally, the neighbouring part of point 24 is occupied by the braiding attachment 9, the claws and the presser foot or the similar pressure inducing member (see FIG. 1). One is therefore compelled to locate the sensing point in front of the presser foot, on the left-hand side of the Figure in relation to line $L_2$ perpendicular to $L_1$ passing by point 9.

If a sensor, for instance a photoelectric cell, is placed at 20*a* near line $L_2$, the cell will be uncovered at a moment when point 23 will be distant from point 24 by a distance which vary as the radius of curvature. Yet it is obvious that for a given operating speed of the sewing machine, point 23 reaches point 24 only if a delay is applied to the operation of the guiding pressure inducing member 15 in relation to the sensing of the deviation of the workpiece contour. It should be supposed in what follows that this delay corresponds to the making for instance of five stitches of a length of two millimeters. The sensing cell should therefore be uncovered at the moment when point 23 reaches point 24' which is distant from point 24 by the length of said five stitches.

Therefore, the cell will operate for pressing the guiding pressure inducing member as if it was displaced by the length of said five stitches in the direction of arrow F and if the delay was cancelled. These positions are represented by the reference numeral provided with index o in FIGS. 3 and 4.

Supposing that for a workpiece 22 having a minimum convex curvature radius of 20mm, cell 20*a* is selected, the stitch represented in FIG. 3 will be started too quickly at the moment when point 23 has not yet reached point 24 and the workpiece will be pivoted by the claws, the presser foot and the needle about point 15 as hereabove discussed and will be blocked between the braiding attachment and the guiding pressure inducing member 15. It can be seen that already after two stitches at p', the bottom of the braiding attachment groove 9', is theoretically very much inside the edge 21 of workpiece 22.

When the needle is moved along the distance of m according to arrow F, the edge 21 will be moved away along $L_1$ from the needle at a distance which is very great in relation to that separating the stitching needle from the bottom 9 of the braiding attachment; this important increase in length causes automatic buckling of the workpiece surface comprised between the claws where the needle operates, and this deformation prevents the stitching from being carried on. The guiding effect of the bottom of the braiding attachment which is referred to in FIG. 2 can be used in fact only if the stress between the bottom of groove 9 and needle or guiding pressure inducing member 15 remains moderate.

As illustrated in FIG. 4, the sensing cells 20*a* to 20*e* for the edge 21 of the workpiece 22 operate therefore because of the delay as if they were positioned at 20*ao* to 20*eo*. It may be seen from this Figure that point 23 where the convex curvature begins will come exactly to point 24, if the circle having the same radius of curvature as the edge and which is tangent to $L_2$ at 24 passes through position o of the selected cell. Therefore, for an edge 21*e*, cell 20*eo* should be selected for an edge 21*c*, cell 20*co*, and for an edge 21*b*, cell 20*bo*. As a matter of fact, and due to the guiding effect of the braiding attachment hereabove discussed, a certain tolerance exists in the location choice for the cell, the choice of a cell corresponding to a slightly larger radius of curvature being possible.

In FIG. 5 is considered the arrival of the stitch at the extremity of the curvature at the moment when point 23' corresponding to the transition arrives at point 24. If for curve 21*b* having $C_b$ as centre, cell 20*e* is used as sensing cell, said cell will be covered when point 23' will be at 23*a*,' that is, at a moment when there will remain a still rather important length 3-pbe of curved stitch to perform. On the contrary, if the same cell 20*e* is used for edge 21*e*, it will be covered when point 23' will be at 23*e*,' and the curved stitch length to be made will only be 2-pe. If on the contrary cell 20*b* is used for edge 21*b*, point 23' will be at 23*b'* at the moment when the cell will be covered and the curved stitch length to be made will then be substantially equal to 3-pe. Therefore, it will be possible to have a delay identical to the lifting of the guiding pressure inducing member in relation to the covering of the cell, whatever the convex radius of curvature of the edge be, and by positioning the cell in a suitable manner, the same cell will control for a given convex curve the pressure operation of the guiding pressure inducing member as well as its lifting at the end of the curved stitch.

The means used for obtaining the delays when the guiding pressure inducing member is being lowered and lifted will not be described in detail. Such means may be electrical of the constant type or of the counting type for the pulses produced by the needle. As a matter of fact, when a guiding pressure inducing member of the pneumatic jack type is used, the inertias of the jack apply a longer delay to the lowering movement (descent and application of the pressure) than during the lifting movement (simple suppression of the pressure), and due to the fact of the very high possible speed of the machine, there is no special delay to foresee if the sewing machine is operating at full speed for a small radius of curvature.

Coming back to FIG. 1, the resilient pressure inducing member 17 applies a braking force on the workpiece during the whole stitching operation and has a tendency to rotate said workpiece in anticlockwise direction about needle 3, i.e. to bring back continuously the edge of the workpiece so that it bears on the bottom of groove 9 of the braiding attachment 8. However such a pressure should be adjustable in relation to the rigidity of the material forming the workpiece 22 to be stitched.

Figure 6:
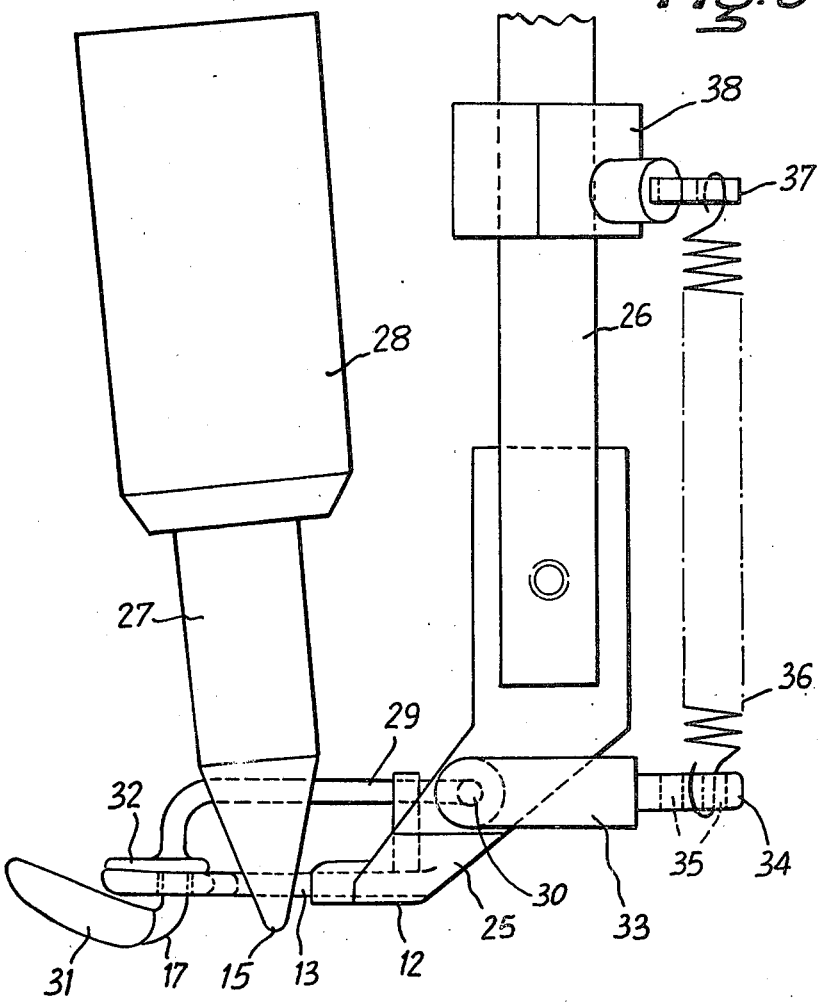
FIG. 6 is a side elevation of the pressure inducing foot provided with a resilient pressure inducing member according to the invention and of the jack forming the guiding pressure inducing member.
Figure 7:
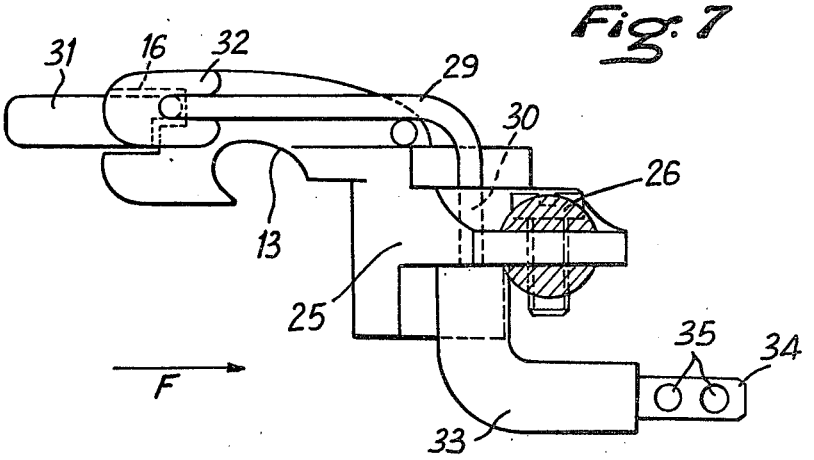
FIG. 7 is a plan view of the pressure inducing foot of FIG. 6.

An embodiment is shown in detail in FIGS. 6 and 7. The pressure inducing foot 25 is held in known manner by a stem 26 which reciprocates for bringing the bearing surface 12 to press against the workpiece during the period when the claws of the presser foot are opened. Moreover, it can be lifted to allow engagement of the workpiece and it is, in FIG. 6, represented in ths position. As hereabove described, a cut-out 13 is formed in the edge of the pressure inducing foot which is close to the presser foot in order to allow passage for the rounded point 15 of stem 27 of a pneumatic jack 28 which forms the guiding pressure inducing member. Said pneumatic jack is mounted fixedly on the sewing machine frame which is not represented. Stem 29 of the resilient pressure inducing member is rotatably mounted inside a bore 30 of the pressure inducing foot, which bore is perpendicular to arrow F. Said stem is curved towards the front and then downwards in order to pass through cut-out 16, hereabove described, of the pressure inducing foot, then it is curved at 17 in order to form the bearing surface on the workpiece to be stitched, and it ends by a heel 31 for avoiding being caught by said workpiece. On the downwardly curved portion of stem 29 is provided a pallet 32 which, as it bears upon the edges of cut-out 16, forms an abutment for limiting the rotation of the resilient pressure inducing member in relation to the pressure inducing foot. On the other end of stem 29 extending out of bore 30 is mounted a bent lever 33 terminated by a blade 34 formed with two holes 35 provided for fixing the extremity of a coil spring 36. The other end of spring 36 is fixed on a blade 37 carried by a ring 38 slidably mounted on stem 26 but adaptable for being blocked in position. The projection of bearing surface 17 below surface 12 is the vertical lifting travel of the pressure inducing foot during the making of a stitch so that in the lowered position of pressure inducing foot 25, bearing surface 17 is always biased onto the workpiece by spring 36. The pressure applied may be adjusted either by adjusting the lengh of the curved lever arm by engaging the end of the spring in one or the other of holes 35, or by displacing ring 38.

Figure 8:
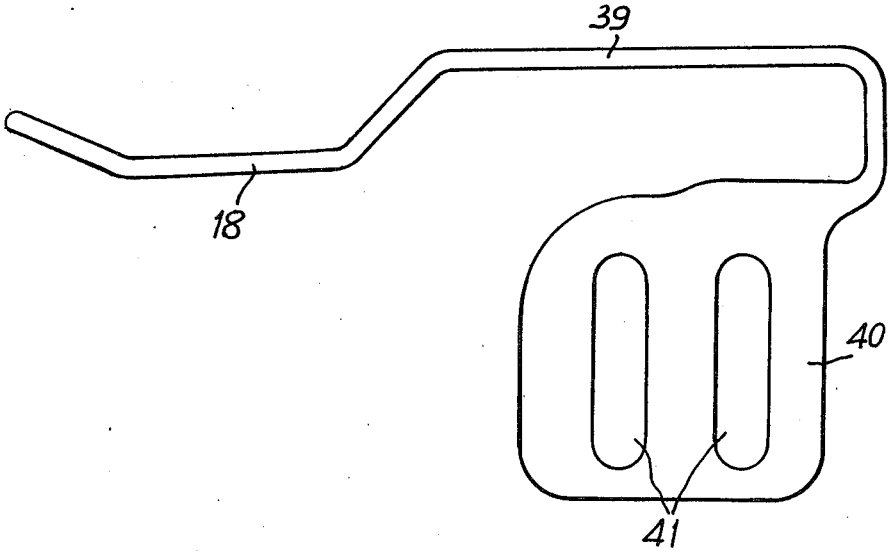
FIG. 8 is a view in elevation of the resilient applicator.

The resilient applicator forming the surface 18 is represented in elevation in FIG. 8. It is made of a simple resilient stem 39 having its extremity fixed on a small plate 30 which may be fixed, by screws passing through bores 41, on a front face which is not represented of the machine frame. The windows 41 are provided for adjusting the height of part 18 above the work-table of the sewing machine in relation to the thickness of the workpiece to be stitched.

The hereabove described embodiments are given as examples and may be modified in their details without departing from the scope of the claims.

I claim:

1. In an automatic guiding device for the workpiece in a sewing machine of the type wherein the needle is moved laterally with the workpiece to feed the same and imposing a drag on the workpiece by a presser foot and feed dogs, comprising a guiding pressure inducing member adapted to bear upon the workpiece, an abutment member mounted laterally toward the inside and sligthly in advance of the stitching needle, a sensor for detecting the position of the edge of the workpiece, said sensor being disposed in advance of the abutment member, means controlled by the sensor for pressing the guiding pressre inducing member onto the workpiece in order to rotate the workpiece on a work-plate of the sewing machine when its edge is beyond a predetermined position measured perpendicular to the stitching path, and a pressure inducing foot bearing upon the workpiece in order to press the workpiece onto the work-plate and to hold the workpiece when the stitching needle and presser foot and claws return backward, the pressure inducing foot rising during forward movement of the stitching needle; the improvement in which said pressure inducing foot has, in its edge adjacent the presser foot, a recess through which passes the stem of the guiding pressure inducing member, said stem having its lower end dome-shaped and pressing directly the workpiece onto the plane surface of the work-plate.

2. An automatic guiding device as claimed in claim 1, and a resilient applicator disposed transversely above the workpiece upstream of the sensor with respect to the stitching direction.

3. An automatic guiding device as claimed in claim 1, and a resilient pressure inducing member acting on the workpiece at a point opposite the abutment member relative to the stitching needle, the resilient pressure inducing member remaining pressed against the workpiece during the whole stitching operation.

4. An automatic guiding device as claimed in claim 3, said resilient pressure inducing member being mounted on the pressure inducing foot, and an adjustable spring biasing said resilient pressure inducing member against the workpiece.

5. An automatic guiding device as claimed in claim 4, and an abutment member for limiting downward movement of the resilient pressure inducing member relative to the presser foot substantially to the lifting height of the pressure inducing foot during the advance movement of the stitching needle.

* * * * *